US010247450B2

(12) United States Patent
Adler

(10) Patent No.: US 10,247,450 B2
(45) Date of Patent: Apr. 2, 2019

(54) DEVICE AND METHOD FOR CONVERTING THERMAL ENERGY

(71) Applicant: ECOP TECHNOLOGIES GMBH, Linz (AT)

(72) Inventor: Bernhard Adler, Gramatneusiedl (AT)

(73) Assignee: ECOP TECHNOLOGIES GMBH, Linz (AT)

( * ) Notice: Subject to any disclaimer, the term of this patent is extended or adjusted under 35 U.S.C. 154(b) by 342 days.

(21) Appl. No.: 15/306,049

(22) PCT Filed: Apr. 22, 2015

(86) PCT No.: PCT/AT2015/050098
§ 371 (c)(1),
(2) Date: Oct. 21, 2016

(87) PCT Pub. No.: WO2015/161330
PCT Pub. Date: Oct. 29, 2015

(65) Prior Publication Data

US 2017/0045270 A1 Feb. 16, 2017

(30) Foreign Application Priority Data

Apr. 23, 2014 (AT) ..... A 50296/2014

(51) Int. Cl.
*F25B 3/00* (2006.01)
*F25B 9/00* (2006.01)

(52) U.S. Cl.
CPC . *F25B 3/00* (2013.01); *F25B 9/00* (2013.01)

(58) Field of Classification Search
CPC ..... F25B 3/00; F25B 9/00
See application file for complete search history.

(56) References Cited

U.S. PATENT DOCUMENTS 2,757,521 A 8/1956 Bennett
4,077,230 A * 3/1978 Eskeli ..... F01K 11/04 415/1

(Continued)

FOREIGN PATENT DOCUMENTS

CN 101883958 A 11/2010
CN 102077038 A 5/2011

(Continued)

OTHER PUBLICATIONS

State Intellectual Property Office of the People's Republic of China, Office Action and Search Report Issued in Application No. 201580029468.6, dated Jun. 25, 2018, 10 pages. (Submitted with Partial Translation).

(Continued)

*Primary Examiner* — David J Teitelbaum
(74) *Attorney, Agent, or Firm* — McCoy Russell LLP

(57) ABSTRACT

A device and a method for converting low temperature thermal energy into high temperature thermal energy using mechanical energy with a rotor for a working medium passing through a closed cycle. The rotor has a compressor unit with compression channels and an expansion unit with expansion channels, and has heat exchangers for exchanging heat between the working medium and a heat exchange medium. The device has an impeller which can be rotated relative to the rotor. The impeller is arranged between supply channels which conduct the flow of the working medium in the heat pump and at least one rotor discharge channel which discharges the flow of the working medium in the heat pump. The supply channels have outlet sections which extend up to a point directly upstream of an inlet opening of the impeller such that flows of the working medium are conducted out of the supply channels.

18 Claims, 8 Drawing Sheets

(56) References Cited

U.S. PATENT DOCUMENTS

| | | | | | |
|---|---|---|---|---|---|
| 4,117,695 | A | | 10/1978 | Hargreaves | |
| 4,726,198 | A | * | 2/1988 | Ouwenga | F25B 3/00 62/499 |
| 5,901,568 | A | * | 5/1999 | Haga | F25B 3/00 165/86 |
| 2007/0204633 | A1 | * | 9/2007 | Whisson | B01D 5/0015 62/93 |

FOREIGN PATENT DOCUMENTS

| | | | |
|---|---|---|---|
| CN | 102893103 | A | 1/2013 |
| DE | 2227189 | A1 | 12/1972 |
| EP | 0119777 | A2 | 9/1984 |
| EP | 0119777 | B1 | 11/1988 |
| FR | 2749070 | A1 | 11/1997 |
| GB | 1575684 | | 9/1980 |
| WO | 9830846 | A1 | 7/1998 |
| WO | 2009015402 | A1 | 2/2009 |
| WO | 2011137476 | A1 | 11/2011 |

OTHER PUBLICATIONS

International Bureau of WIPO, International Preliminary Report on Patentability Issued in Application No. PCT/AT2015/050098, Nov. 3, 2016, WIPO, 15 pages.

ISA European Patent Office, International Search Report Issued in Application No. PCT/AT2015/050098, dated Aug. 19, 2015, WIPO, 4 pages.

* cited by examiner

DEVICE AND METHOD FOR CONVERTING THERMAL ENERGY

CROSS REFERENCE TO RELATED APPLICATIONS

The present application is a U.S. National Phase of International Patent Application Serial No. PCT/AT2015/050098, entitled "DEVICE AND METHOD FOR CONVERTING THERMAL ENERGY," filed on Apr. 22, 2015. International Patent Application Serial No. PCT/AT2015/050098 claims priority to Austrian Patent Application No. A 50296/2014, filed on Apr. 23, 2014. The entire contents of each of the above-cited applications are hereby incorporated by reference in their entirety for all purposes.

TECHNICAL FIELD

The invention relates to a device for converting thermal energy with a low temperature into thermal energy with a higher temperature and vice versa using mechanical energy, having a rotor rotatably arranged around a rotational axis for a working medium passing through a closed cycle process, wherein the rotor has a compressor unit with multiple compression channels, in which flows of the working medium may be guided substantially radially to the outside with respect to the rotational axis for a pressure increase, and an expansion unit with multiple expansion channels, in which flows of the working medium may be guided substantially radially to the inside with respect to the rotational axis for a pressure decrease, wherein the rotor further has heat exchangers for exchanging heat between the working medium and a heat exchange medium, and having an impeller which can be rotated relatively to the rotor, provided in a heat pump operating state for maintaining the flows of the working medium around the rotational axis of the rotor and/or in a generator operating state for using the flow energy of the working medium.

BACKGROUND AND SUMMARY

The invention further relates to a method for converting thermal energy with a low temperature into thermal energy with a higher temperature and vice versa using mechanical energy, wherein a working medium passes through a closed cycle process within a rotor rotating around a rotational axis, wherein multiple flows of the working medium are guided substantially radially to the outside with respect to the rotational axis for a pressure increase, wherein the flows of the working medium are guided substantially radially to the inside with respect to the rotational axis for a pressure decrease, wherein heat is exchanged between the working medium and a heat exchange medium, with the working medium being guided around the rotational axis of the rotor in a heat pump operating state for maintaining the flows of the working medium and/or through an impeller in a generator operating state for using the flow energy of the working medium.

Rotating heat pumps and/or thermal engines in which a gaseous working medium is guided within a closed thermodynamical cycle process are already known from the prior art.

WO 2009/015402 A1 describes a heat pump in which the working medium passes through a cycle process in a piping system of a rotor, including the working steps of a) compression of the working medium, b) conduction of heat away from the working medium by means of a heat exchanger, c) expansion of the working medium, and d) supply of heat to the working medium by means of a further heat exchanger. The pressure increase and/or pressure decrease of the working medium is caused mainly by centrifugal acceleration, with the working medium flowing radially to the outside in a compression unit and radially to the inside in an expansion unit, with respect to a rotational axis. The conduction of heat away from the working medium to a heat exchange medium of the heat exchanger occurs in a section of the piping system extending axially and/or parallel to the rotational axis and having an associated co-rotating heat exchanger including the heat exchange medium.

Furthermore, this prior art already employs an impeller which is, in particular, used to maintain the flow of the working medium during rotational operation. In one way, the impeller may be arranged rotationally fixed, which results in a movement relative to the piping system carrying the working medium due to the rotationally fixed arrangement. According to another way, it has already been proposed to equip the impeller with a motor for generating a movement relative to the piping system. Moreover, in this device the impeller may be connected to a generator in order to convert the generated shaft power into electrical energy using the relative movement of the impeller.

In the prior art, various impellers for maintaining a fluid flow are known, and such impellers may be designed as compressors, expansion turbines or guide vanes. In the prior art, axial and radial designs are known as the limiting forms for the type of the flow-through of impellers. In hybrid forms such as impellers with a diagonal flow-through, generally the same considerations as for the radial and/or axial flow component apply. When using impellers with an axial flow-through, so-called axial fans (or axial compressors in general) or axial turbines, conventional dimensioning can usually be implemented. However, the axial construction has the drawback that compared to the radial construction lower pressure increases can be effected, thus requiring the axial impellers to be formed multi-staged in most cases. In a multi-stage design, so-called guide vanes are attached between the impellers in order to deflect the flow. This generates a spin with the rotation of the surrounding rotating axial blades, removes the spin substantially completely from the flow or generates a counter spin to the direction of rotation. Regarding the installation of radial impellers, which have the advantage of higher pressures per stage when compared to axial impellers and can thus often be formed single-staged, up to now a model that is also used with multi-stage radial compressors and/or centripetal turbines has been applied, in which the impellers are arranged in a fixed housing.

Extensive experiments, however, revealed that the arrangement of the impellers known from the prior art does not provide satisfactory results in generic devices in which the supply and discharge lines of the impeller are arranged rotationally within the rotor housing. It has been observed that the effectiveness of a radial fan, for example, dropped from 80% when using a non-rotating housing to 25% when using a rotating housing.

According to this, there is a considerable need for improvements of the impellers to be able to better take into account the complex basic conditions within the rotor during the process, which includes multiple working steps.

Therefore, the object of the present invention is to provide a rotating device for converting thermal energy as initially mentioned, wherein the drawbacks of the prior art are eliminated and/or at least significantly mitigated. According to this, it is a particular aim of the invention to maintain the flow of the working medium around the rotational axis with as little energy losses as possible.

According to the invention, the impeller is arranged between supply channels, which supply the flow of the working medium in the heat pump operating state, and at least one discharge channel of the rotor, which discharges the flow of the working medium in the heat pump operating state, wherein the supply channels have outlet sections which run substantially parallel to the rotational axis and extend up to a point directly upstream of an inlet opening of the impeller such that individual flows of the working medium from the supply channels can be guided into the impeller substantially parallel to the rotational axis.

According to this, the invention is based on the surprising finding that the effectiveness of the impeller may be significantly improved by guiding the working medium as individual flows parallel to the rotational axis, i. e. in an axial direction, before it enters the impeller. For the purposes of this disclosure, the extension of the outlet sections of the supply channels to a point directly upstream of the impeller means that the flows of the working medium in the supply channels are not supplied to the impeller in a combined way, but separated from one another. Preferably, the outlet sections of the supply channels are arranged in regular angular distances and in the same radial distance around the rotational axis. According to this, multiple axial flows of the working medium are introduced into the impeller. Afterwards, the working medium flows into the at least one discharge channel of the rotor. According to this, the working medium is guided directly from the impeller, i. e. without an intermediate fixed housing, into the rotor. The rotor thus forms a rotating housing for the impeller, preferably enclosing the impeller in its entirety. Thus, the working medium is guided through the impeller located within the rotor, with the working medium not being guided in a fixed housing as is the case in the prior art. In this way, the flow energy of the working medium can be substantially maintained when it passes through the cycle process. Another advantage is that dynamic seals for the working medium against the environment are not required. In the conventional layout of impellers, a fixed housing has been provided. In contrast to this, a rotor is provided in the device according to the invention, so the components surrounding the impeller rotate during operation. In order to take into account the different situations of installation, it would have been obvious to consider only the relative speed between the impeller and the rotor, i. e. the differential speed between the absolute rotor speed and the absolute impeller speed. However, this consideration turned out to be fundamentally faulty. With the radial supply of the working medium from the rotating supply channels into the impeller, which is common in the prior art, a spin is generated during the radial leaving of the supply channel, in particular due to the Coriolis acceleration, and is formed radially to the inside against the direction of rotation during a flow when viewed from the relative, rotating system. This spin changes the characteristics of the supply flow, in particular the velocity triangles, significantly, so there was no way how dimensioning according to conventional methods could have been successful. According to the invention, however, the working medium is guided out of the supply channels transporting the working medium in the axial direction. Advantageously, this results in the Coriolis acceleration becoming almost zero and no or no substantial spin being generated. Thereby, the transition into the impeller may be calculated more easily and, advantageously, is not dependant on the speed of the impeller and the surrounding housing of the rotor or the relative flow rate, either.

In order to allow stable operation, it is advantageous to connect a number of radial discharge channels as small as possible to the impeller. The smaller the number of the connected radial discharge channels is, the more stable the operation, since the probability of a flow interruption of a discharge channel decreases steadily with a decreasing number of discharge channels. As a consequence, exactly one discharge channel per impeller is provided in a preferred embodiment. Thus, in this embodiment, exactly one impeller is provided for each discharge channel guided radially to the outside, while multiple impellers (and a corresponding number of discharge channels) may be provided. For economical reasons, in an alternative preferred embodiment the impeller is connected to at least three discharge channels. Preferably, not more than twelve discharge channels are connected to the impeller. The embodiment described refers only to the number of the discharge channels leading away directly radially from the impeller. However, it is definitely possible for a radial discharge channel to be divided into multiple heat exchanger channels in the region far from the axis, preferably after a turn into the axial direction.

In order to obtain pressure differences with high effectiveness during flow through the compression and expansion channels while reliably preventing the formation of spin flows before entering the impeller, it is favorable if the supply channels have supply sections extending substantially in the radial direction, which are arranged between the outlet sections and inner heat exchangers with respect to the rotational axis. Preferably the supply sections are longer than the outlet sections of the supply channels.

In order to accomplish heat exchange between the working medium and a heat exchange medium at a higher temperature, it is favorable for the at least one discharge channel to be connected to the compression channels, which are connected to outer heat exchangers with respect to the rotational axis.

In order to maintain the cycle process during operation with as low energy demand as possible, it is favorable to arrange the impeller closer to the rotational axis, in the radial direction, than the inner heat exchanger, with the impeller being preferably arranged concentrically around the rotational axis of the rotor. According to this, the rotational axes of the rotor and the impeller are preferably arranged flush. Thereby, a particularly efficient way of operation may be achieved.

In order to convert the radial flows of the working medium in the supply channels into axial flows before entering the impeller, it is advantageous for the supply channels to have arcuately curved walls at the outlet sections, which cause a deflection of the working medium by substantially 90° from the supply sections into the outlet sections. Because of the arcuate walls of the expansion channels at the outlet end, the working medium may be continuously deflected into an axial flow while the flows of the working medium are not or only slightly disturbed by the deflection.

In order to introduce the flows of the working medium into the impeller individually, i.e. substantially unmixed and/or separated from one another, it is advantageous for the outlet sections of the supply channels to be formed between separating elements, which extend substantially in the radial and axial direction with respect to the rotational axis, in particular substantially even separating walls. By arranging separating walls, guiding the axial flows of the working medium in the outlet sections of the supply channels into the impeller may be achieved in an especially simple manner, unmixed and substantially free from spin with respect to the rotating rotor, which is the housing for the impeller.

For better controllability, in particular in the partial load range, it is favourable for the separating elements to be adjustable in front of the impeller. Advantageously, this makes it possible to generate a defined entering spin which may be adjusted by means of the separating elements. In contrast to the spin occurring during entering into the impeller due to the Coriolis acceleration in the prior art, this defined entering spin may be calculated and/or simulated when designing the device. The device according to the invention is usually designed for a certain operation point. Here, the inlet angle of the separating elements, in particular, may be dimensioned such that the flow has a consistent transition, i. e. an inflow without a substantial change in direction, into the blade region of the impeller when observed in the relative, rotating impeller system. Typically, when changing the speed of the impeller and/or in case of varying relative flow rates, i. e. during operation outside of the design point, the inflow angles of the flow change, thereby generating an inconsistent inflow into the blade region of the impeller. This effect reduces the effectiveness of the impeller during operation outside of the design point. In order to eliminate this drawback, the separating elements may be adjusted for operation outside of the design point in such a way that with respect to the relative, rotating impeller system the working medium flows in a consistent manner when entering the blade region of the impeller. In this way, effectiveness may be increased. This action also enables the impeller to generate higher pressure and a larger maximum volume flow, thus expanding the range of application.

For maintaining the flow of the working medium when passing through the cycle process, it is favourable if the impeller includes a plurality of blades, in particular arcuately curved ones. The blades accelerate the working medium in the circumferential direction with respect to the rotational axis before the working medium is guided into the compression channels via outlet openings between the outer edges of the impeller blades.

According to a preferred embodiment, the impeller has a radial section free from blades on the side facing the rotational axis. In the ring-shaped radial section of the impeller, the flows of the working medium, which are guided separately within the supply channels, are combined. In this way, the working medium may be homogenised in the radial section before the working medium, which is flowing radially to the outside from the radial section, is accelerated by the rotating blades and then discharged into the discharge channels.

In order to supply the working medium entering in the axial direction to the blades, it is favourable for the impeller to have an arcuately curved deflection wall on the radial section for deflecting the working medium by substantially 90° in the radial direction.

In order to substantially maintain the flow energy of the working medium, it is favourable for the at least one discharge channel to have an inlet section arranged inclined to the radial direction, which is connected to a discharge section extending substantially in the radial direction. The inlet section of the discharge channel preferably extends in that direction in which a consistent transition of the flow occurs, i. e. in which an inflow without a substantial change of direction is present. This is obtained by vector addition during design. According to this, the working medium is introduced into the inlet sections, which are connected to the discharge sections extending substantially in the radial direction, in the tangential direction with respect to an enclosure and/or outer surface of the impeller having a substantially circular cross-section. Preferably, the inlet sections and the compression sections are connected to one another via arcuately curved transition sections.

In order to drive the impeller and thereby accelerate the working medium when passing through and/or use the rotational energy of the impeller, it is advantageous for the impeller to have an impeller shaft, in particular one that is rotatable parallel to the rotational axis of the rotor and that is connected to a motor or a generator. According to this, the impeller may be connected to a motor in order to generate a relative movement between the rotor and the impeller. In this design, the impeller is arranged in a heat pump operating state for maintaining the circular guiding of the working medium. On the other hand, the impeller may be connected to a generator in order to convert the shaft power present on the impeller shaft into electrical energy using the relative movement of the impeller. When using the device in such a way, a flow of the natural circulation type is obtained because of the different temperature levels at the heat exchangers. The energy of the flow is then converted into shaft power in the impeller, which acts as a turbine, and subsequently converted into electric power by means of a generator. Preferably, a portion of this energy is used for a motor driving the rotor. In the present disclosure, the terms "inlet" and "outlet" refer to the function of the impeller for maintaining the flow of the working medium around the rotational axis, i. e. when the impeller is used as a fan in the heat pump operating state. During the function of the impeller as a turbine for generating electrical energy, the flow direction of the working medium is reversed so the outlet sections of the supply lines are becoming the inlet sections of the discharge lines, for example.

In a preferred embodiment, the rotational axes of the impeller and the rotor coincide. With the impeller shaft being arranged flush on top of the shaft of the rotor, advantageously no asymmetrical forces due to centrifugal acceleration acting on the suspension of the impeller may be generated. Preferably, a dedicated motor/generator is provided for the impeller shaft so the impeller may be driven independently from the rotor having the compression and expansion channels; in this case the rotor is connected to a second motor. Alternatively, the same motor may be used for driving the impeller and the rotor and/or the same generator may be used for utilizing the rotational energy of the impeller and the rotor.

Surprisingly, it has been proven advantageous to arrange the motor for rotation of the impeller in the same direction of rotation as the rotor having the expansion and compression channels for the working medium. If the impeller rotates in the same direction as the main rotor, the acceleration field of the main rotor may be used advantageously. Thereby, the efficiency of the impeller may be improved even with respect to an arrangement having a non-rotating housing, since the compression ratio in the impeller itself is increased due to centrifugal acceleration, and this compression has a significantly higher effectiveness than the pressure increase due to velocity changes occurring during the transition from the impeller to the discharge channel, for example.

The device according to the invention uses the centrifugal acceleration while flowing through the compression and expansion channels of the rotor in order to generate different pressure and/or temperature levels of the working medium. For converting the thermal energy of the working medium via kinetic energy and vice versa, it is favorable to provide at least one inner heat exchanger with respect to the rotational axis and at least one outer heat exchanger with respect to the rotational axis for heat exchange between the working medium and a heat exchange medium. The heat exchangers are arranged co-rotating within the rotor. Depending on the flow direction of the working medium, the device may be operated as a heat pump, in which the rotor is put into rotational motion by a drive and the cycle process flow is generated by a fan. The opposite flow direction corresponds to an operation as a thermal engine for generating electric power, wherein different temperature levels are used to generate a flow which is converted into mechanical energy in the impeller, which acts as a turbine, and eventually converted into electrical energy in a generator. In this state of operation, the rotor is driven by a motor, which is supplied by the electrical energy obtained from the turbine, for example.

Preferably, the heat exchangers are arranged substantially parallel to the rotational axis of the rotor. In this context, the heat exchangers are connected between the compression and expansion channels. The inner heat exchanger is intended for heat exchange at a lower temperature, and the outer heat exchanger is intended for heat exchange at a higher temperature.

For increasing the performance of the device, it is favorable to provide both multiple inner heat exchangers and multiple outer heat exchangers. Preferably, the inner heat exchangers on one side and the outer heat exchangers on the other side are arranged in regular angular distances with respect to the rotational axis. Preferably, there are just as many inner and outer heat exchangers as compression and expansion channels, respectively. According to this, the inner and the outer heat exchangers are connected to one another as pairs, each by a compression and an expansion channel. Moreover, it is preferably provided that the number of supply and discharge channels for the impeller is equal to the number of inner and outer heat exchangers, respectively.

According to a further preferred embodiment, the number of the inner heat exchangers is a multiple of the outer heat exchangers or vice versa.

The heat exchangers can be designed especially efficient if the at least one inner heat exchanger and the at least one outer heat exchanger extend substantially parallel to the rotational axis while the compression and expansion channels extend between the inner heat exchanger and the outer heat exchanger. Preferably, multiple inner heat exchangers and multiple outer heat exchangers are provided, each arranged in an equal radial distance to the rotational axis. Also preferably, in this embodiment, a number of compression and expansion channels equal to the number of the inner and outer heat exchangers, respectively, is provided.

In a particularly preferred embodiment, the impeller has multiple impeller stages through which the working medium may flow sequentially. In this embodiment, the supply channels have outlet sections which run substantially parallel to the rotational axis and extend up to a point directly upstream of the inlet opening of the first impeller stage seen in the flow direction. The sequential impeller stages are connected to one another by means of a deflection, which deflects the working medium between the impeller stages. Preferably, the deflection has outlet sections which run substantially parallel to the rotational axis and extend up to a point directly upstream of the inlet opening of the following impeller stage seen in the flow direction. In this way, the working medium is always guided to the next impeller stage and introduced in the direction of the rotational axis. The last impeller stage seen in the flow direction is connected to the at least one discharge channel.

With an increasing mass flow in the cycle process, a not permanently increasing pressure difference is observed at the impeller. According to this, especially when there is a low mass flow and high speed of the rotor, a dropping pressure difference at the impeller is caused as the mass flow increases, then the pressure difference rises again. For this reason, it is favorable to use an impeller having a gradient as steep as possible, i. e. at a certain speed of the impeller and a speed of the main rotor, a gradient dropping as steeply as possible is preferred upon reaching maximum pressure. Such a gradient is obtained in particular with multi-stage impellers. Since the characteristic curve of the process (i. e. the pressure required over the mass flow) and the characteristic curve of the blades (i. e. the pressure generated over the mass flow) usually show two intersections with only one of them being a stable operation point, a vertical characteristic curve for pressure generation would be ideal. This could be put into practice by reciprocating engines (such as piston engines), for example. However, a multi-stage pressure increase using impellers achieves a similar effect in an advantageous manner by obtaining a very steep gradient from a certain point on.

The object forming the basis of the invention is further achieved by a method of the initially mentioned type, wherein in the heat pump operating state individual flows of the working medium are guided to a point directly upstream of the impeller and introduced into the impeller substantially parallel to the rotational axis. According to this, the flows of the working medium are guided into the impeller individually and/or separated from one another and in the axial direction.

The advantages and technical effects of this method are apparent from the above explanations, to which reference can be made hereby.

Surprisingly, it has proven advantageous to rotate the impeller in the same direction of rotation as and at a higher absolute speed than the rotor having the expansion and compression channels. The rotation of the impeller in the direction of rotation of the rotor provides a higher absolute speed of the impeller, which causes a correspondingly higher centrifugal acceleration and thus a more efficient compression of the working medium. If the impeller and the rotor rotate in the same direction of rotation, the centrifugal compression effect is increased proportionally, and consequently efficiency is improved.

BRIEF DESCRIPTION OF THE FIGURES

The invention will be explained in more detail below by means of exemplary embodiments illustrated in the drawings, however without being limited to them. Individually, in the drawings.

DETAILED DESCRIPTION

Figure 1:
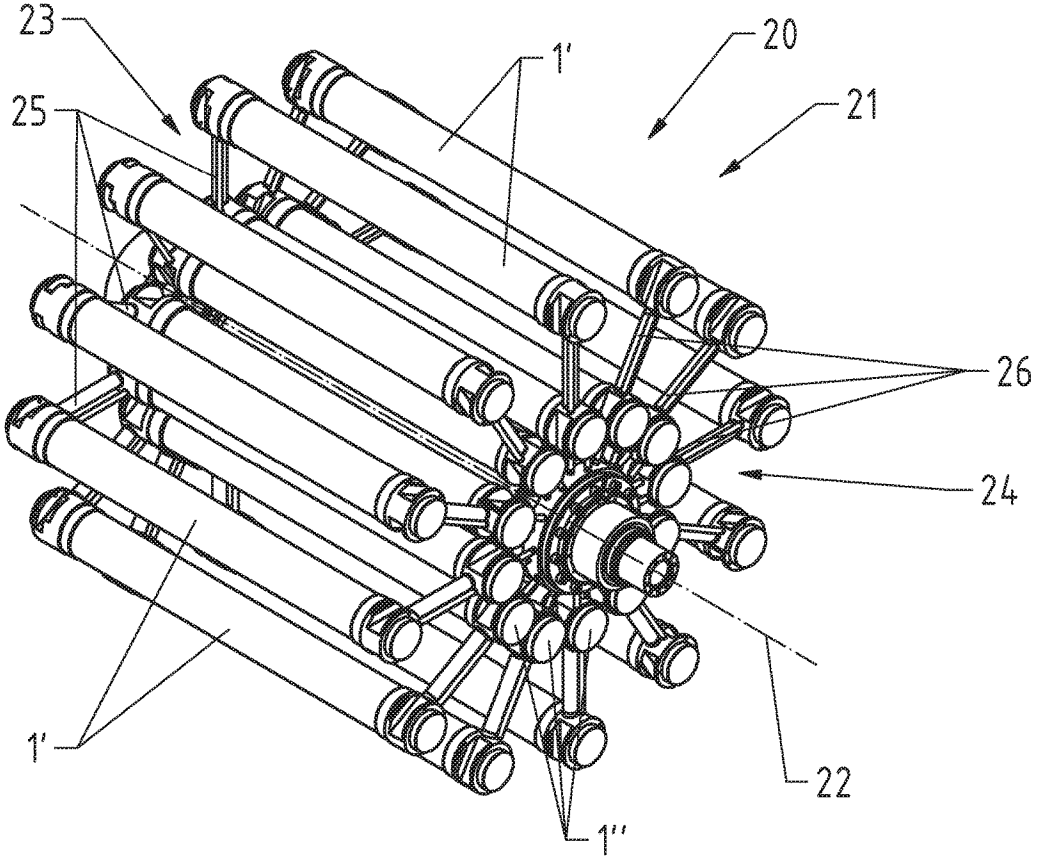
FIG. 1 schematically shows a diagrammatic view of a device according to the invention for converting thermal energy, in which a working medium in a rotor passes through a closed cycle process, wherein the cycle process is closed by means of a rotating impeller.

FIG. 1 shows a device 20 for converting thermal energy using mechanical energy and vice versa, which is used as a heat pump in the embodiment shown. The device 20 includes a rotor 21 which is rotatable around a rotational axis 22 by means of a motor (not illustrated). The rotor 21 includes a compressor unit 23 and an expansion unit 24, which have flow channels for a working medium. When flowing through the rotor 21, the working medium, for example a noble gas, passes through a closed cycle process, which includes the working steps of a) compression of the working medium, b) heat exchange between the working medium and a heat exchange medium in an outer heat exchanger 1', c) expansion of the working medium, and d) heat exchange between the working medium and a heat exchange medium in an inner heat exchanger 1". For this purpose, the compressor unit 23 has compression channels 25 extending substantially in the radial direction, in which the working medium flows to the outside in the radial direction with respect to the rotational axis 22. Due to centrifugal acceleration, the working medium is compressed in the compression channels 25. Correspondingly, the working medium is guided substantially radially to the inside in expansion channels 26 of the expansion unit 24 in order to decrease the pressure.

The compressor unit 23 and the expansion unit 24 are connected to one another by flow channels extending axially, i. e. in the direction of the rotational axis 22, in which heat exchange between the working medium and a heat exchange medium, for example water, takes place. For this purpose, outer heat exchangers 1' and inner heat exchangers 1" with respect to the rotational axis are provided, extending substantially parallel to the rotational axis 22. When the device 20 is operated as a heat pump, the working medium in the outer heat exchangers 1', which has been compressed in the compression channels 25, transfers heat to a heat exchange medium with a first, comparably high temperature while the working medium which has been expanded in the expansion channels 26 receives heat from the heat exchange medium with a second, comparably low temperature.

According to this, the centrifugal acceleration acting on the working medium is used to generate various pressure levels and/or temperature levels. High temperature heat is extracted from the compressed working medium, and heat having a comparably low temperature is supplied to the expanded working medium. When operating the device 20 as a motor, the working medium flows through the flow channels in an opposite direction. Correspondingly, the heat exchange is changed, with heat being supplied to the working medium at the outer heat exchanger 1' and heat being extracted from the working medium at the inner heat exchanger 1".

As can further be seen from FIG. 1, multiple inner heat exchangers 1", twelve in the embodiment shown, and multiple outer heat exchangers 1', twelve in the embodiment shown, are provided, arranged in regular angular distances with respect to the rotational axis. The inner heat exchangers 1" and the outer heat exchangers 1' each extend substantially parallel to the rotational axis 22, with the compression 23 and the expansion channels 25 extending between the inner heat exchangers 1" and the outer heat exchangers 1'.

Figure 2A:
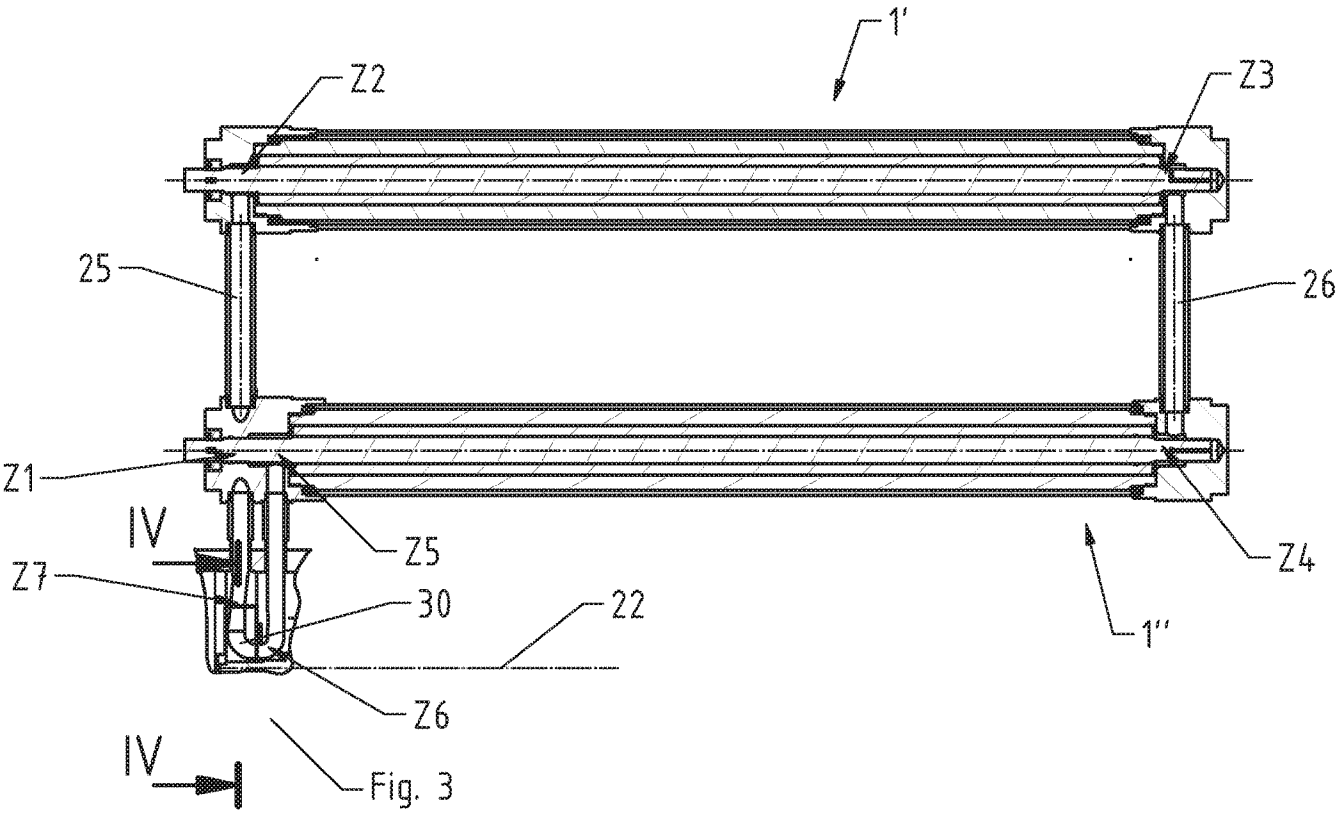
FIG. 2A shows a longitudinal section through the device of FIG. 1, wherein only the parts relevant for the function of the impeller are shown for the sake of clarity.

In FIG. 2A, parts of the device 20 are shown in a longitudinal section, wherein only one of the inner heat exchangers 1" and one of the outer heat exchangers 1' are depicted. Moreover, an impeller 30 for maintaining the flow of the working medium around the rotational axis 22 in the embodiment shown can be seen in FIG. 2A. On one side, the impeller 30 is connected to supply channels 31 (cf. FIG. 3) for receiving the working medium from the inner heat exchangers 1". Furthermore, the impeller 30 is connected to discharge channels 32 (cf. FIG. 3) for guiding the working medium into the compression channels 25 of the compressor unit 23. The compression channels 25 are connected to the outer heat exchangers 1'.

As can further be seen from FIG. 2A, in the radial direction the impeller 30 is arranged closer to the rotational axis 22 than the inner heat exchanger 1". In the embodiment shown, the rotational axis of the impeller 30 is arranged flush on top of the rotational axis 22 of the rotor 21 in order to reduce the loads due to centrifugal acceleration acting on the suspension of the shaft of the impeller 30.

Figure 2B:
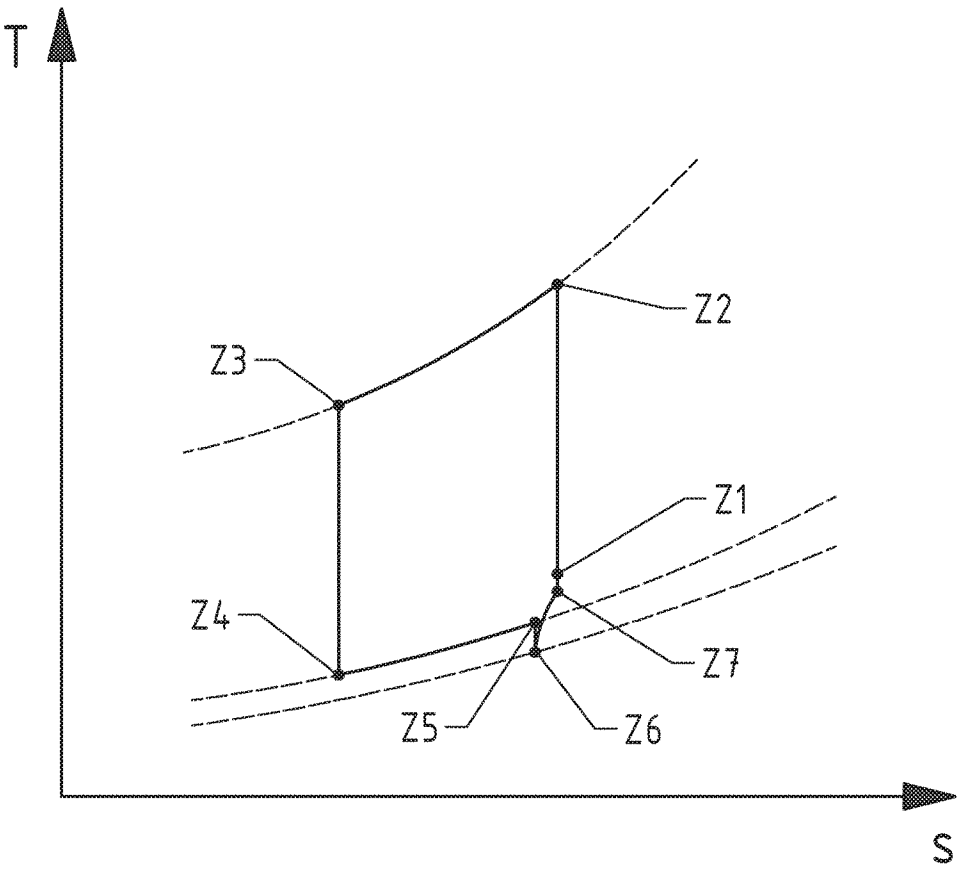
FIG. 2B shows a temperature/entropy diagram of the cycle process performed in the device according to the invention.

FIG. 2B shows a diagram of temperature (T) and entropy (S), in which the individual states of the working medium are designated by Z1 to Z7. Correspondingly, the positions within the device 20 where the working medium substantially reaches the states Z1 to Z7 are marked in FIG. 2A. According to this, the following process steps are passed through during operation as a heat pump (during operation as a thermal engine the cycle process would be performed in reverse order):

1 to 2: substantially isentropic compression due to the main rotation from the radius Z1 of the heat exchanger 1" near the axis to the radius Z2 of the heat exchanger 1' far from the axis;

2 to 3: substantially isobaric heat transfer from the working medium to the heat exchange medium in the outer heat exchanger 1' at a comparably high temperature and consistent radius of the flow;

3 to 4: substantially isentropic expansion due to the main rotation from the radius of the outer heat exchanger 1' to the radius of the inner heat exchanger 1";

4 to 5: substantially isobaric heat transfer at a comparably low temperature and consistent radius in the inner heat exchanger 1";

5 to 6: substantially isentropic expansion due to the main rotation from the radius of the inner heat exchanger to the inlet radius of the impeller;

6 to 7: compression within the impeller, wherein the losses cause an increase in entropy; and 7 to 1: substantially isentropic compression due to the main rotation from the outlet of the impeller to the radius according to state Z1.

Figure 3:
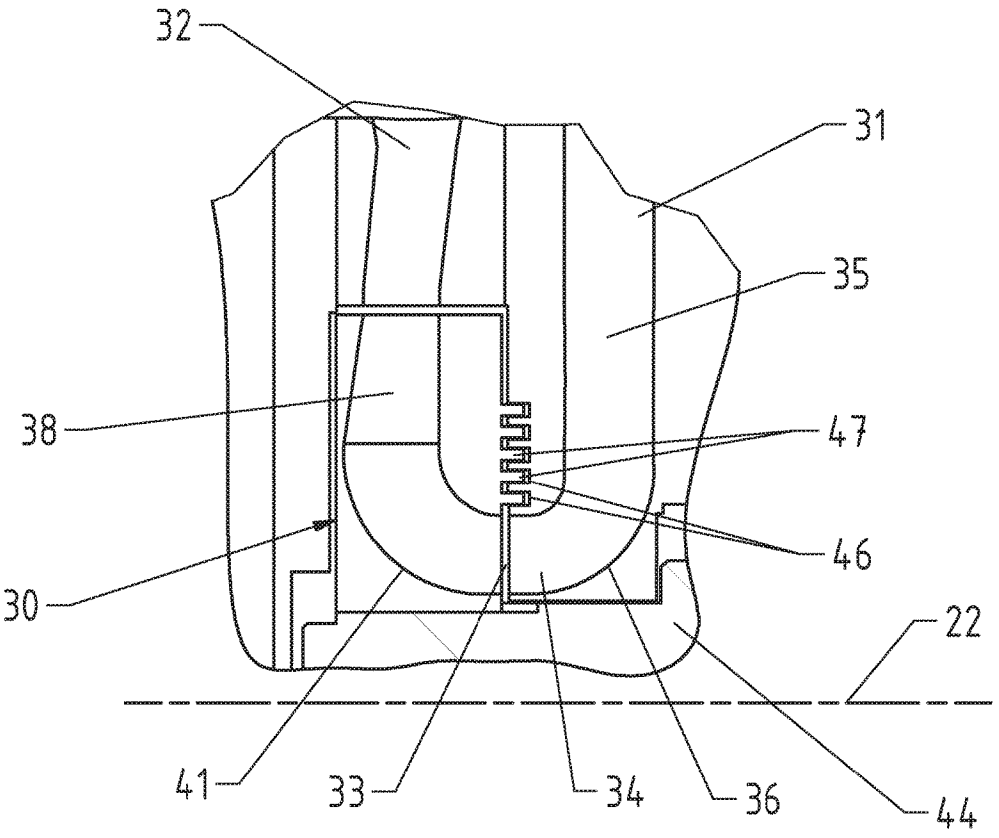
FIG. 3 shows a longitudinal section of the device according to FIGS. 1, 2A in the region of the impeller.

As can be seen from FIG. 3, the supply channels 31 have outlet sections 34 running substantially parallel to the rotational axis 22 and extending up to a point directly upstream of an inlet opening 33 of the impeller 30 such that the flows of the working medium can be guided into the impeller 30 separated from one another in the supply channels 31 and substantially parallel to the rotational axis 22.

As can further be seen from FIG. 3, the supply channels 31 have supply sections 35 extending substantially in the radial direction, which are arranged between the outlet sections 34 terminating in the impeller 30 and the inner heat exchangers 1". The discharge channels 32 are connected to the compression channels 25 (cf. FIGS. 1, 2A), which guide the working medium to the outer heat exchangers 1'.

As can be seen from FIG. 3, in particular, the supply channels 31 have arcuately curved walls 36 at the outlet sections 34, which cause a deflection of the working medium by substantially 90° from the radial supply sections 35 into the axial outlet sections 34.

Figure 4:
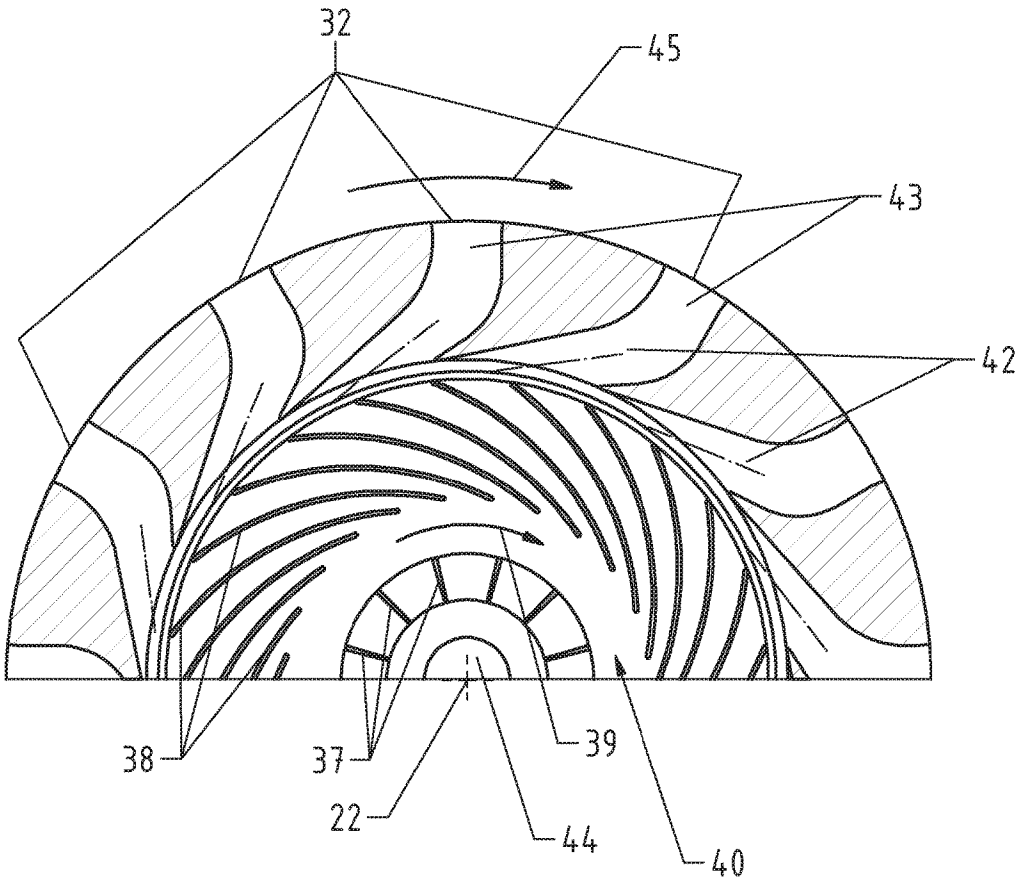
FIG. 4 shows a transverse section of the device according to line IV-IV in FIG. 2A in the region of the impeller, wherein both the outlet sections of the supply channels and the inlet sections of the discharge channels are to be seen.

As can be seen from FIG. 4, in particular, the outlet sections 34 of the supply channels 31 are delimited by separating elements 37 extending substantially in the radial and axial direction with respect to the rotational axis 22, which are formed by substantially even separating walls in the embodiment shown. The separating elements 37 have a radial extension and are arranged in a star pattern. In the embodiment shown, the outlet sections 34 are thus arranged regularly and in consistent radial distances around the rotational axis 22 of the rotor 21.

As can further be seen from FIG. 4, the impeller 30 has a plurality of arcuately curved blades 38 for accelerating the working medium in the direction of rotation 39 of the impeller 30 while it flows through the impeller 30. On the side facing the rotational axis 22, the impeller 30 has a radial section 40 free from blades 38, in which the flows of the working medium from the supply channels 31 are combined and homogenized. On the radial section 40 an arcuately curved deflection wall 41 is provided (cf. FIG. 3) for deflecting the working medium by substantially 90° from the axial flow when entering the impeller 30 to a radial flow in front of the blades 38.

As can be seen from FIG. 4, the discharge channels 32 include inlet sections 42 extending inclined to the radial direction with respect to an enclosure of the impeller 30, i. e. with respect to the outer surface of the impeller 30 having a circular cross-section, which inlet sections are connected to discharge sections 43 extending substantially in the radial direction.

Figure 6:
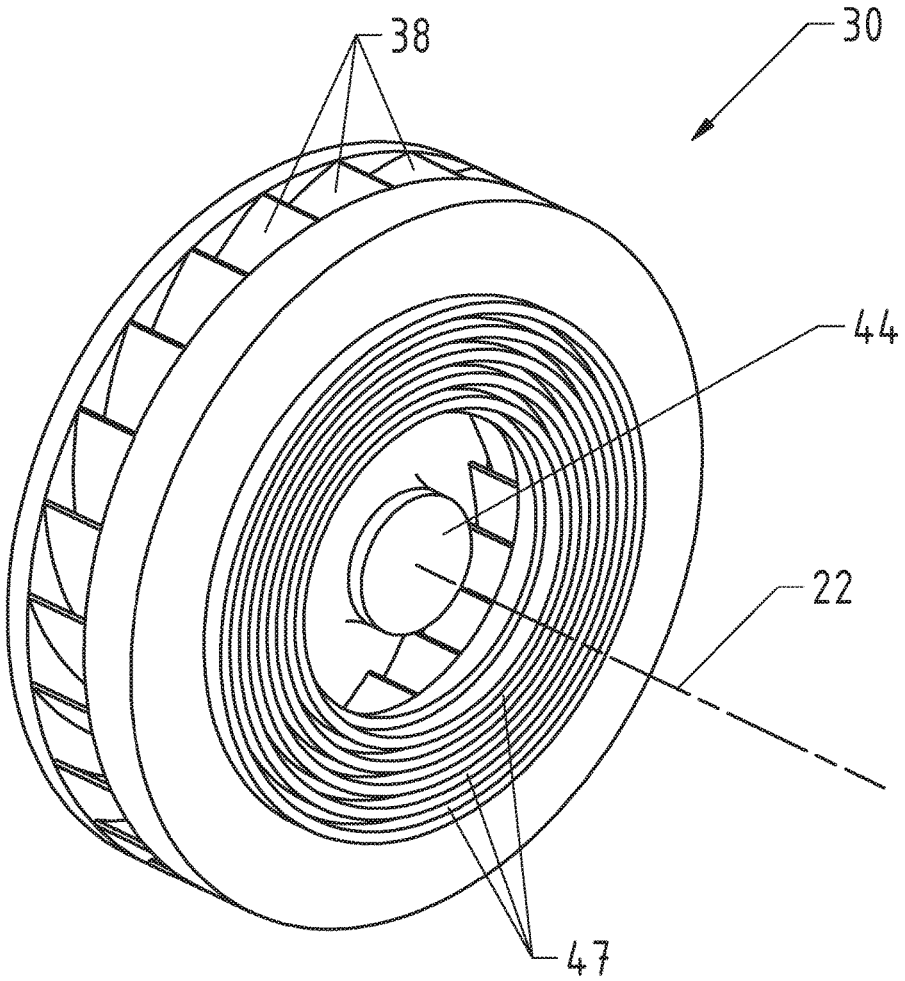
FIG. 6 schematically shows a diagrammatic view of the impeller of the device illustrated in FIGS. 1 to 5.

As can be seen schematically from FIGS. 4, 6, the impeller 30 includes an impeller shaft 44 which is connected to a motor (not shown). The motor is configured to rotate the impeller 30 in the direction of rotation 45 of the rotor 21. In the embodiment shown, the rotational axis of the impeller 44 and the rotational axis 22 of the rotor 21 coincide. During operation as a thermal engine, a generator is connected to the impeller 30, which acts as a turbine in this case. When an adequate mass flow passes through the turbine, it converts a resulting differential pressure into shaft power.

Figure 5:
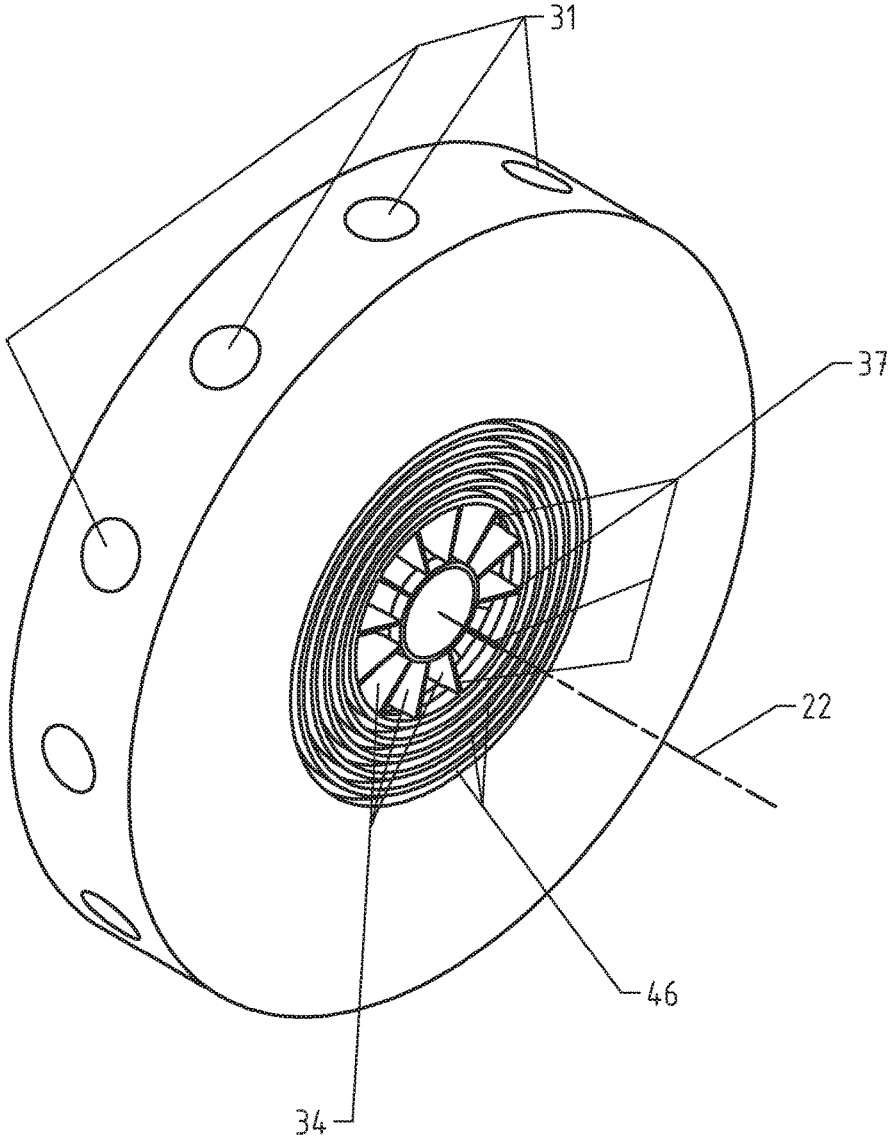
FIG. 5 shows a schematic diagrammatic view of parts of the rotor in the region of the supply channels, which have outlet sections extending in the axial direction upstream of the inlet point into the impeller.

As can be seen from FIG. 5, the device 20 has dynamical sealing gaps 46 intended to minimize back flows due to increased pressure at the outlet of the impeller 30 with respect to the inlet. Matching ribs 47 of the impeller 30 engage the sealing gaps 46 in order to provide multiple gaps that are as small as possible.

Figure 7:
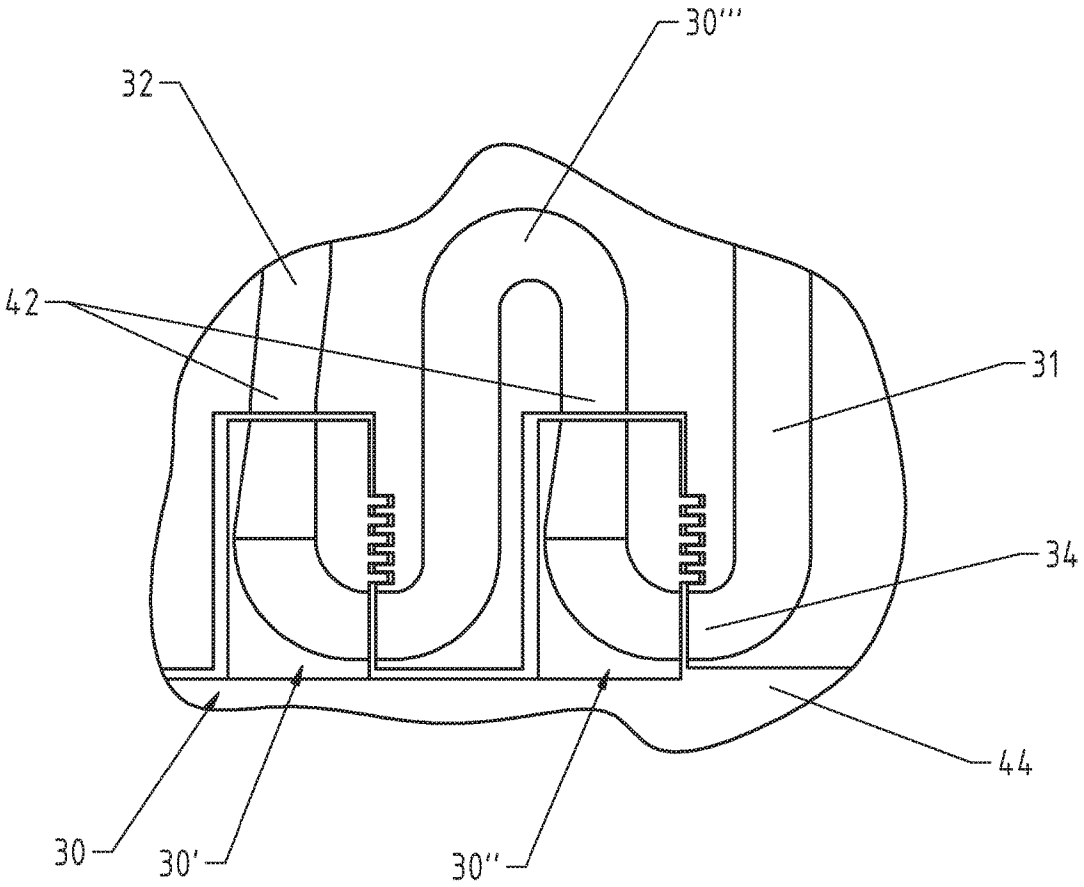
FIG. 7 shows a longitudinal section of the device according to FIG. 3 in the region of the impeller, which has multiple impeller stages for a sequentially flow-through in this embodiment.

FIG. 7 shows an alternative embodiment in which the single impeller 30 has multiple—two in the embodiment shown—impeller stages 30', 30" for sequential flow-through. The impeller stages 30', 30" are connected to one another via a deflection 30'" for deflecting the working medium, after the first impeller stage 30", from a flow radially to the outside first to a flow radially to the inside and then to a flow in the direction of the rotational axis 22 to a point directly upstream of the second impeller stage 30'. Each impeller stage 30', 30" is designed according to the single-stage design of FIGS. 1 to 6. In the embodiment shown, the impeller stages 30', 30" are arranged on the same impeller shaft 44, which is connected to a motor or a generator. Alternatively, the impeller stages 30', 30" may be arranged on separate impeller shafts, with each impeller stage 30', 30" being connected to a motor and/or a generator.

The invention claimed is:

1. A device for converting thermal energy with a low temperature into thermal energy with a higher temperature and vice versa using mechanical energy, comprising a rotor rotatably arranged around a rotational axis for a working medium passing through a closed cycle process, wherein the rotor comprises a compressor unit with multiple compression channels, in which flows of the working medium may be guided radially to the outside with respect to the rotational axis for a pressure increase, and an expansion unit with multiple expansion channels, in which flows of the working medium may be guided radially to the inside with respect to the rotational axis for a pressure decrease, wherein the rotor further has heat exchangers for exchanging heat between the working medium and a heat exchange medium, and having an impeller which can be rotated relatively to the rotor, provided in a heat pump operating state for maintaining the flows of the working medium around the rotational axis of the rotor and/or in a generator operating state for using a flow energy of the working medium, wherein the impeller is arranged between supply channels, which supply the flow of the working medium in the heat pump operating state, and at least one discharge channel of the rotor, which discharges the flow of the working medium in the heat pump operating state, wherein the supply channels have outlet sections which run parallel to the rotational axis and extend up to a point directly upstream of an inlet opening of the impeller such that individual flows of the working medium from the supply channels are guided into the impeller parallel to the rotational axis.

2. The device according to claim 1, wherein the supply channels have supply sections extending in a radial direction, which are arranged between the outlet sections and inner heat exchangers with respect to the rotational axis.

3. The device according to claim 2, wherein in the radial direction the impeller is arranged closer to the rotational axis than the inner heat exchangers, with the impeller being preferably arranged concentrically around the rotational axis of the rotor.

4. The device according to claim 2, wherein the supply channels have arcuately curved walls at the outlet sections, which cause a deflection of the working medium.

5. The device according to claim 2, wherein the outlet sections of the supply channels are formed between separating elements, which extend in the radial and axial direction with respect to the rotational axis.

6. The device according to claim 2, wherein the impeller includes a plurality of blades.

7. The device according to claim 6, wherein the impeller has a radial section free from blades on the side facing the rotational axis.

8. The device according to claim 7, wherein the impeller has an arcuately curved deflection wall on the radial section for deflecting the working medium in the radial direction.

9. The device according to claim 6, wherein the plurality of blades are arcuately curved blades.

10. The device according to claim 2, wherein the at least one discharge channel has an inlet section arranged inclined to the radial direction, which is connected to a discharge section extending in the radial direction.

11. The device according to claim 1, wherein the at least one discharge channel is connected to the compression channels, which are connected to outer heat exchangers with respect to the rotational axis.

12. The device according to claim 1, wherein the impeller has an impeller shaft that is rotatable parallel to the rotational axis of the rotor and that is connected to a motor or a generator.

13. The device according to claim 12, wherein the motor is arranged for rotation of the impeller in the same direction of rotation as the rotor having the expansion and compression channels for the working medium.

14. The device according claim 1, wherein at least one inner heat exchanger with respect to the rotational axis and at least one outer heat exchanger with respect to the rotational axis are provided.

15. The device according to claim 14, wherein the number of the inner heat exchangers is a multiple of the outer heat exchangers or vice versa.

16. The device according to claim 14, wherein the at least one inner heat exchanger and the at least one outer heat exchanger extend in parallel a direction to the rotational axis while the compression and/or expansion channels extend between the at least one inner heat exchanger and the at least one outer heat exchanger.

17. The device according to claim 14, wherein both multiple inner heat exchangers and outer heat exchangers are provided.

18. The device according to claim 1, wherein the impeller has multiple impeller stages through which the working medium flows sequentially.

* * * * *